United States Patent [19]

Chupka et al.

[11] Patent Number: 4,919,797

[45] Date of Patent: Apr. 24, 1990

[54] SCREENING APPARATUS FOR PAPER MAKING STOCK

[75] Inventors: David E. Chupka, Middletown; Irenee J. Phillippe, Monroe, both of Ohio

[73] Assignee: The Black Clawson Company, Middletown, Ohio

[21] Appl. No.: 308,338

[22] Filed: Feb. 9, 1989

[51] Int. Cl.[5] ..... B07B 1/04

[52] U.S. Cl. ..... 209/273; 209/306; 209/380

[58] Field of Search ..... 209/268, 270, 273, 380, 209/305, 306; 210/415

[56] References Cited

U.S. PATENT DOCUMENTS

| | | | |
|---|---|---|---|
| 2,347,716 | 5/1944 | Staege | 209/273 |
| 2,835,173 | 5/1958 | Martindale | 2/270 |
| 3,759,392 | 9/1973 | Syrjanen | 29/273 X |
| 3,849,302 | 11/1974 | Seifert | 209/273 |
| 3,865,243 | 2/1975 | Salminen | 209/273 X |
| 3,953,325 | 4/1976 | Nelson | 209/273 |
| 3,970,548 | 7/1976 | Seifert et al. | 209/240 |
| 4,105,543 | 8/1978 | Seifert | 209/240 |
| 4,328,096 | 5/1982 | Chupka et al. | 209/240 |
| 4,663,030 | 5/1987 | Chupka et al. | 209/306 |
| 4,812,229 | 3/1989 | Tra | 209/273 X |

*Primary Examiner*—Donald T. Hajec

*Attorney, Agent, or Firm*—Biebel, French & Nauman

[57] ABSTRACT

In screening apparatus for paper making stock comprising a cylindrical screening member dividing the interior of a pressure housing into a supply chamber and an accepts chamber, and also comprising a rotor mounted for rotation in the supply chamber and including a plurality of vanes mounted thereon in angularly spaced relation with each other and in relatively closely spaced relation with the screening member, each of the vanes is of generally airfoil shape and is oriented with its leading edge closest to the screening member and with the surface portion thereof trailing the leading edge diverging from the screening member to create a positive pressure force along the leading edge followed by a negative pressure force between the trailing portion and the screening member. A cap on each end of each vane extends radially outwardly from each end of the trailing portion of the vane and substantially closes the adjacent axial end of the space between the trailing portion of the vane and the screening member, and a bar is mounted on the trailing ends of each of these caps to define a slot extending along the trailing edge of the vane and leading directly from the space between the vane and the screening member to space on the radially inner side of the vane. This bar is located in more closely spaced relation with the screening member than the trailing portion of the vane to contain the negative pressure force developed by the vane within the space between the trailing portion of the vane and the opposed surface of the screening member.

8 Claims, 2 Drawing Sheets

SCREENING APPARATUS FOR PAPER MAKING STOCK

BACKGROUND OF THE INVENTION

Paper mills have for many years made extensive use, for the cleaning of paper making stock of screening apparatus embodying a cylindrical perforated screening member defining supply and accepts chambers on the opposite sides thereof in a closed housing, and including a rotor member which operates in one of the chambers to keep the screening perforations open and free from solid material tending to cling to the screening surface. The stock or furnish to be screened is delivered to the supply chamber adjacent one end of the screening cylinder, and the material rejected by the screening cylinder is collected and discharged from the opposite end of the supply chamber.

The assignee of this invention has manufactured and sold many such screens in accordance with a series of U.S. patents, commencing with Staege No. 2,347,716, and followed by Martindale No. 2,835,173 and numerous other patents including Seifert Nos. 3,849,302 and 4,105,543. Starting with the construction shown in the Martindale patent, all such screens manufactured and sold by applicant's assignee have been characterized by a rotor which included bars or vanes of airfoil section moving in closely spaced but noncontacting relation with the surface of the screening cylinder for the purpose of creating alternating positive and negative pressure waves or pulses effective on the perforations in the screening cylinder to prevent plugging thereof.

The art has experimented to a considerable extent with detailed variations in screens of the above type, including variations in the vane shape and other forms of rotor, some such variations being shown in Seifert-Chupka U.S. Pat. No. 3,970,548, Chupka-Seifert U.S. Pat. No. 4,328,096 and Chupka et al U.S. Pat. No. 4,663,030. In general, the vaned rotors marketed by applicant's assignee have included vanes of substantially the same airfoil configuration as viewed in a section taken radially of the rotor axis.

SUMMARY OF THE INVENTION

In accordance with the present invention, it has been discovered that modification of the construction of the individual vanes on a screen rotor of the above type, by providing each vane with means for concentrating the negative pressure force which it creates in the space between the trailing portion of the vane and the screening cylinder, results in a significant increase in capacity, in terms of tons of dry fiber per day. This in some instances has been as high as 25%, which translates to a corresponding decrease of as much as 20% in the power consumption per ton. Also, these significant practical advantages are achieved without adversely affecting other operational characteristics of the screens, such as reject rate and efficiency.

In the simplest form of the invention, the desired concentration of the negative pressure force developed between the trailing portion of the vane and the screening cylinder is effected by providing the vane at each end with a cap which extends radially outwardly beyond, and axially behind, the trailing portion of the outer surface of the vane. This cap provides a barrier between the negative pressure zone and the interior of the screening chamber beyond (above and below) the ends of the vane, and this in turn causes the suction developed in the negative pressure zone to be satisfied by pulling solid material away from the screen surface rather than by drawing unscreened stock from beyond the ends of the vane.

In a further embodiment of the invention, in addition to caps ont he ends of each vane as described above, a bar is supported between the extending ends of the two caps and is held thereby in spaced relation with the trailing edge of the vane. This bar is so located that it has a close running clearance relative to the adjacent surface of the screening cylinder, but there is a space between the bar and the trailing edge of the vane in which the suction force is concentrated or contained, and thereby applied to the adjacent surface of the screen rather than being able to pull stock from inside the vane around the trailing edge of the vane.

The combination of the end caps and this bar thus effectively concentrates at least the major part of the negative force in the space defined by the two end caps, the trailing edge of the vane and the bar carried by the end caps. This result has been found to promote significantly increased efficiency in the screening apparatus as a whole, as further described hereinafter.

Other objects and advantages of the invention will be apparent from or pointed out in the course of the description of the preferred embodiment which follows.

DESCRIPTION OF THE PREFERRED EMBODIMENT

Figure 1:
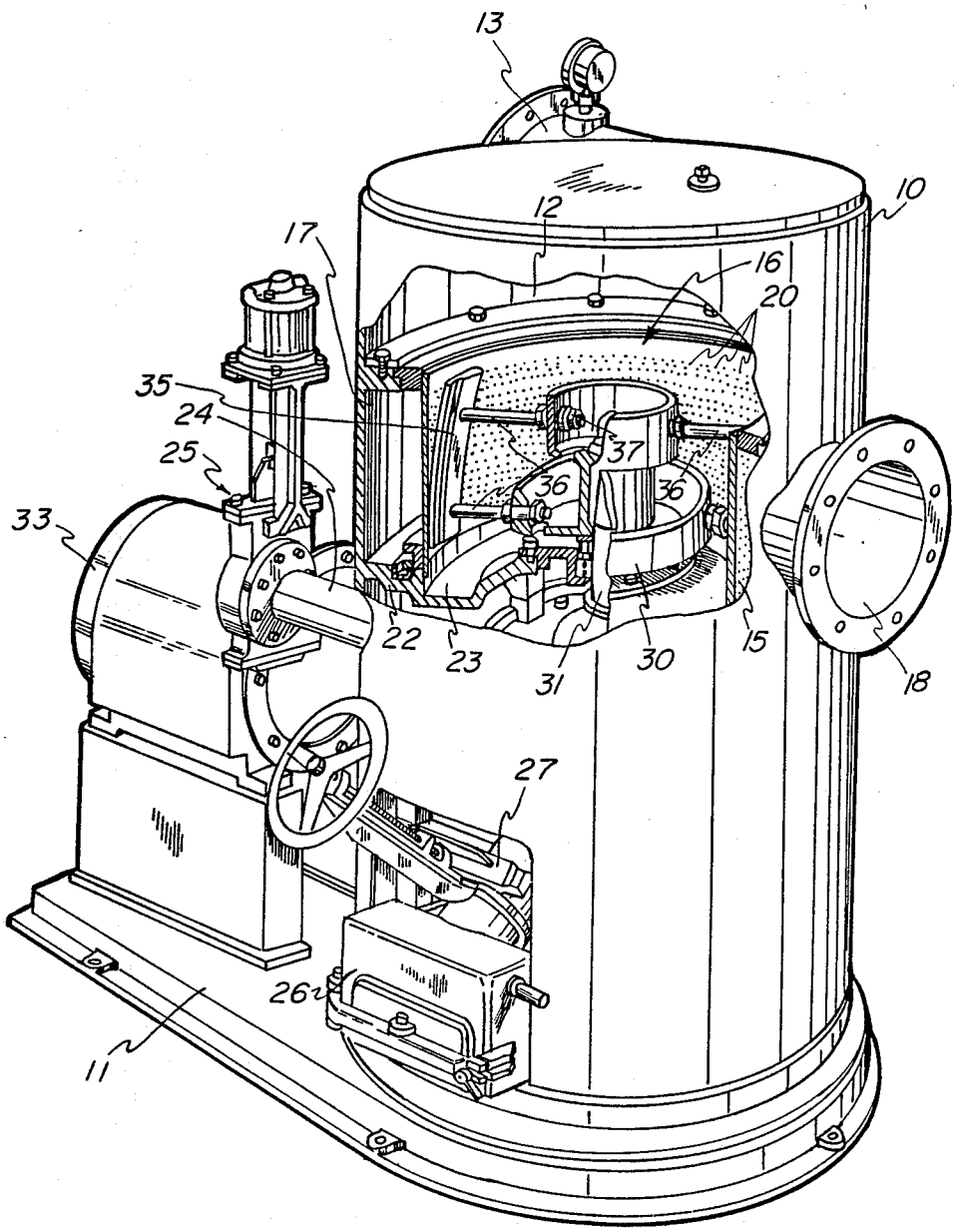
FIG. 1 is a perspective view, partly broken away, illustrating screening apparatus incorporating an embodiment of the invention.
Figure 2:
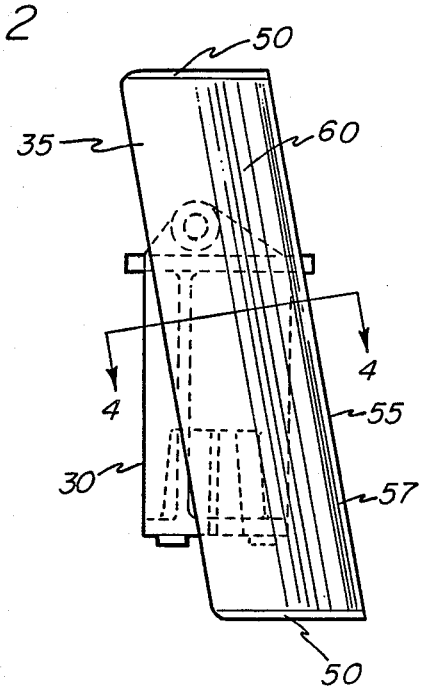
FIG. 2 is a side elevation of the radially outer side of the rotor in FIG. 1.

The screening apparatus shown in FIG. 1 is constructed generally in accordance with co-owned Seifert U.S. Pat. No. 4,105,543. It comprises a main housing 10 on a base 11, and in the upper end of the housing there is an inlet chamber 12 having a tangential inlet port 13 to which the furnish to be screened is applied under pressure and in clockwise direction as viewed from above. A cylindrical screen member 15 divides the interior of the housing below chamber 12 into a central supply chamber 16 and an accepts chamber 17 having an outlet port 18. The screen member 15 is provided with multiple cylindrical perforations 20 which may be of conventional size and spacing, and which may be replaced by slots as disclosed in co-owned Seifert U.S. Pat. No. 3,849,302.

The bottom wall 22 of the supply chamber 16 includes a trough 23 leading to a discharge port 24 provided with a control valve assembly 25 which can be preset to provide a desired continual bleed of reject-rich stock. Heavy particles which settle into the trough 23 drop therefrom to the heavy trash collection box 26 by way of manually controlled valve 27. The liquid flow from port 24 is commonly subjected to further screening after dilution, or it may in part be recirculated to inlet port 13.

A rotor 30 is supported on a drive shaft 31 in the center of supply chamber 16 and is driven through suitable gearing or belts by a motor 33 also mounted on the base 11. Vanes 35 are mounted on the rotor 30 by support rods 36 and adjustable connections 37 which provide for positioning the vanes 35 in properly spaced relation with the inner surface of screen member 15, as further described hereinafter.

The vanes 35 extend substantially the full length of the screening surface of the screen member 15, and they are helically curved and so arranged that the upper end of each vane is spaced forwardly of the lower end in the direction of rotation of the rotor, shown as clockwise. While FIG. 1 shows the rotor as including only two vanes 35, it is preferable to provide at least four such vanes where the screening cylinder is of the order of 2 feet in diameter, and more such vanes with screening cylinders of larger diameter.

Figure 4:
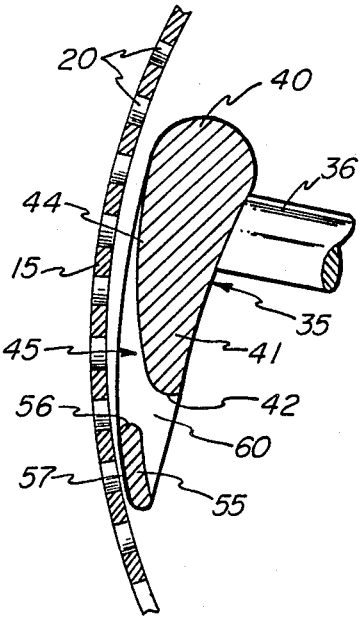
FIG. 4 is a section on the line 4—4 in FIG. 2 and on a larger scale.
Figure 3:
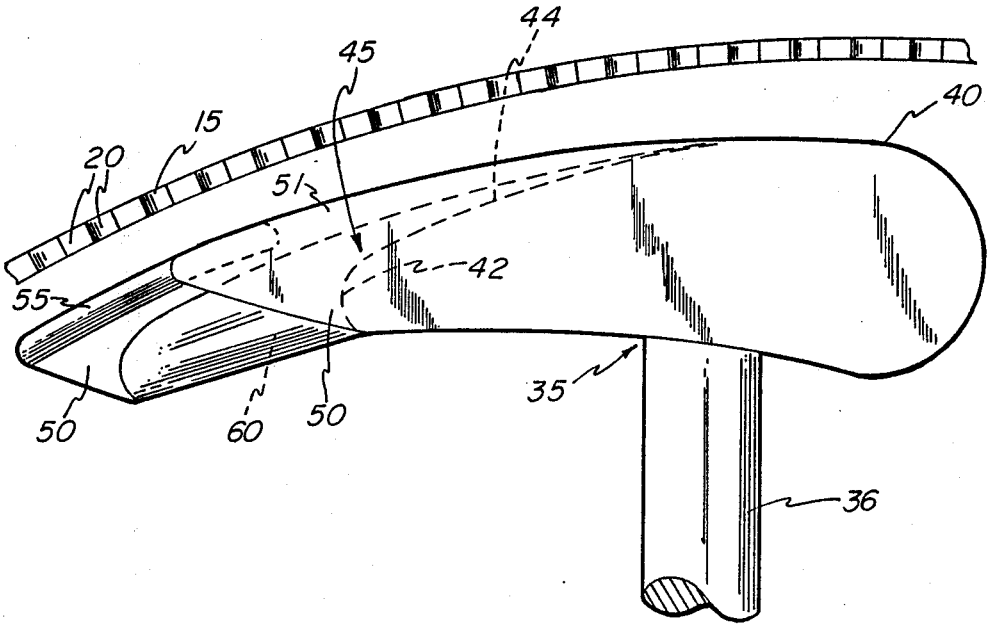
FIG. 3 is an end view of the vane shown in FIG. 2, looking down on FIG. 2 and on a larger scale.

Referring now to FIGS. 3 and 4, each of the vanes 35 has a solid periphery and is of substantially airfoil shape in cross section so that the vane has a rounded leading edge portion 40 of maximum thickness and a trailing portion 41 which is of progressively reduced thickness from the leading portion 40 to the trailing edge 42 of the vane. In addition, the vane is so oriented on the rotor that the outer surface 44 of the trailing portion 41 of the vane diverges progressively from the adjacent surface of the screen cylinder 15 to provide a space 45 therebetween which is of generally wedge shaped configuration as viewed axially of the rotor.

The vane 35 as described up to this point could be essentially a duplicate of the vane disclosed in the above Martindale patent. Its function is directly related to the fact that in screening apparatus of this type, the major force causing stock to pass through the screening perforations in cylinder 15 is the supply pressure under which the stock is fed to the screen, but the resulting pressure drop through these perforations will inherently cause particles too large for acceptance to be held by suction on the inlet side of cylinder 15.

The function of the vane 35 in operation is to create a high pressure wave, pulse or zone in the confined space between the leading edge 40 of the vane and the adjacent surface of the screening cylinder 15, which is followed by a negative pressure wave or pulse in the space 45. These opposed pressure forces alternate in urging accepted stock through the perforations 20 in the screening cylinder to the accepts chamber 17 and then drawing back any solid material of too large particle size to pass through the perforations.

The present invention was developed as a result of observation of the fact that in the operation of vanes of the space 45 is not limited to the adjacent area of the surface of the screening cylinder 15, but can also extend to the spaces adjacent the ends of the vane, as well as to the space behind the trailing edge 41 of the vane. Any such dilution of the suction force applied directly to the entry side of the screening cylinder tends to diminish the effectiveness of the action of the vane in keeping the screen perforations clear, and the purpose of the invention is to improve the operation of the screening apparatus from this standpoint.

This objective and result are achieved in two stages. First, and end cap 50 of flat metal plate stock is mounted on each end of the vane, and as shown in FIG. 3, each of these plates extends both circumferentially behind and radially outwardly of trailing portion 41 of the vane.

The outer edge of each of these plates 50 includes a portion 51 curved substantially concentrically with the rotor 30. This curved edge 51 is spaced from but at least as close to the adjacent surface of the screening cylinder 15 as the leading edge 40 of the vane, and preferably somewhat closer, e.g. a spacing of 0.25 inch where the radial spacing between the leading edge 40 and the screening cylinder has a minimum of 0.50 inch. These plates therefore effectively segregate the space 45 from direct communication with the spaces within the chamber 16 beyond the ends of the vanes, and thereby prevent the suction force developed in the space 45 from being satisfied by unscreened stock flowing around the ends of the vane.

In addition, a bar 55, which may termed a "spoiler" bar, is supported by and between the extended ends of the plates 50 in trailing spaced relation with the trailing edge 41 of vane 35. As shown in FIG. 3, the bar 55 may be formed of plate stock approximately 0.25 inch in thickness, and it is provided with a rounded leading edge 56 and a curved outer edge 57 which is substantially concentric with the rotor 30. Alternatively, the bar 55 may be of airfoil shape similar to but smaller than vane 35. The end caps 50 and bar 55 thus combine to define a slot 60 of roughly hour glass shape as viewed in FIG. 4 which extends the full length of the vane 30 and leads directly from the space 45 to the interior of the supply chamber 16 behind the foil.

In operation, the bar 55 combines with the trailing edge 41 of the associated vane to enclose the negative pressure space or zone 45 so that the negative pressure developed in that zone is substantially contained therein so that it is concentrated on the surface area of the screening cylinder which forms the outside of the zone. Also, the hour glass shape of the passage 60 should result in accelerated flow through the narrow portion of the passage, between the vane edge 42 and the bar edge 56, and resulting further reduced pressure in the zone 45. This assures that the negative pressure in the zone 45 will be applied directly to the surface of the screening cylinder in such manner as to draw back any too-large solid particles which have been drawn against the surface of cylinder 15 and covered any of the perforations therethrough, and this action will be repeated on every portion of the inlet side of cylinder 15 as each vane 35 passes it.

Screening apparatus constructed as shown in FIG. 1 has been tested with a variety of feed stock furnishes to obtain comparative data with a rotor equipped with vanes of the invention and also a rotor equipped with vanes of the same construction but without the end caps 50 and bar 55. In each test, the power requirement for the rotor equipped with the vanes of the invention was regulated, by adjusting the rotor speed, to equal as nearly as possible that for the rotor equipped with standard vanes for the comparable test. In every case, use of the vanes of the invention resulted in an increase in the range of 10 to 25% in capacity in terms of tons of fiber per day, which in turn converts to a decrease in the range of approximately 8 to 20% in the power consumed for each ton of fiber. Throughout these tests, other screening characteristics, such as the reject rate and cleaning efficiency, were essentially not affected.

While the forms of apparatus herein described constitute preferred embodiments of the invention, it is to be understood that the invention is not limited to these precise forms of apparatus and that changes may be made therein without departing from the scope of the invention which is defined in the appended claims.

What is claimed is:

1. Screening apparatus for paper making stock comprising:

(a) a pressure housing, (b) a cylindrical screening member having screening perforations therethrough and dividing the interior of said housing into a supply chamber and an accepts chamber on opposite sides of said screening member, (c) a rotor mounted for rotation in said supply chamber and including a plurality of vanes having a solid periphery of generally airfoil shape in cross section mounted thereon in angularly spaced relation with each other and in relatively closely spaced relation with said screening member, (d) each of said vanes being oriented with the leading edge thereof closest to said screening member and with the surface portion thereof trailing said leading edge to the trailing edge of said vane diverging from said screening member to create a positive pressure force along said leading edge thereof followed by a negative pressure force between said trailing portion and said screening member, and (e) means carried by each of said vanes in trailing relation with said trailing edge thereof for substantially containing said negative pressure force in the space between said trailing portion of said vane and said screening member and thereby concentrating said force on the surface portion of said screen member within said space while providing for direct flow from said space to the interior of said supply chamber.

2. Screening apparatus as defined in claim 1 wherein said containing means comprises a cap on each end of each of said vanes which extends radially outwardly from each end of said trailing portion of said vane and substantially closes the adjacent axial end of said space.

3. Screening apparatus as defined in claim 1 wherein said containing means comprises a bar mounted on each of said vanes in spaced relation therewith rearwardly of the trailing edge thereof to define a slot extending along said trailing edge and leading directly from said space between the trailing portion of said vane and said screening member to the radially oterh side of said vane.

4. Screening apparatus as defined in claim 1 wherein said containing means comprises a cap on each end of each of said vanes extending across said space between the trailing portion of said vane and said screening member, and a bar extending between the trailing ends of said cap and located in closely spaced relation with the surface of said screening member to define with said vane a slot extending along the trailing edge of said vane and leading directly from said space between the trailing portion of said vane and said screening member to the radially other side of said vane.

5. Screening apparatus as defined in claim 3 wherein said bar is supported with the surface thereof adjacent said screening member in at least as closely spaced relation with said screening member as said leading edge of said vane.

6. Screening apparatus as defined in claim 4 wherein said bar is supported by said caps with the surface thereof closest to said screening member in at least as closely spaced relation with said screening member as said leading edge of said vane.

7. A vane for mounting on a rotor supported for rotation within a cylindrical screening member in screening apparatus for paper making stock, said vane having a generally airfoil shape in cross section to provide a leading edge of maximum thickness and a trailing edge of minimum thickness connected with said leading edge by a trailing portion of generally tapered thickness, means for mounting said vane on said rotor with said leading edge thereof closest to said screening member and with the radially outer surface of said trailing portion diverging from said screening member, and a cap on each end of said vane which extends radially outwardly from each end of said trailing portion of said vane as well as circumferentially beyond said trailing edge of said vane.

8. A vane as defined in claim 7 further comprising a bar mounted between the trailing ends of said caps in spaced relation with said trailing edge of said vane to define a slot extending along said trailing edge.

* * * * *